United States Patent [19]

Ketterer

[11] 4,018,172

[45] Apr. 19, 1977

[54] FEED REGULATOR CLAMPING DEVICE

[75] Inventor: Stanley Joseph Ketterer, Jamesburg, N.J.

[73] Assignee: The Singer Company, New York, N.Y.

[22] Filed: Aug. 12, 1976

[21] Appl. No.: 713,952

[52] U.S. Cl. ..... 112/215

[51] Int. Cl.[2] ..... D05B 27/02

[58] Field of Search ..... 112/215

[56] References Cited

UNITED STATES PATENTS

| | | | |
|---|---|---|---|
| 3,527,183 | 9/1970 | Szostak | 112/215 |
| 3,534,696 | 10/1970 | Willenbacher et al. | 112/215 |
| 3,921,552 | 11/1975 | Daman | 112/215 |

*Primary Examiner*—George H. Krizmanich

*Attorney, Agent, or Firm*—Edward L. Bell; Robert E. Smith; Edward P. Schmidt

[57] ABSTRACT

A feed regulator clamping device for a sewing machine, operative during the feed of a work material to insure retention of a selected feed against feed back of forces from the feed dogs. The device includes a clamping plate supported by a feed shaft to extend between the feed regulator and a stationary object such as a boss of the sewing machine frame. A face cam affixed to the feed shaft, which also supports feed cams, engages with the clamping plate during the feed of the work material thereby to cant the clamping plate and create a frictional connection between the feed regulator and the sewing machine frame.

4 Claims, 5 Drawing Figures

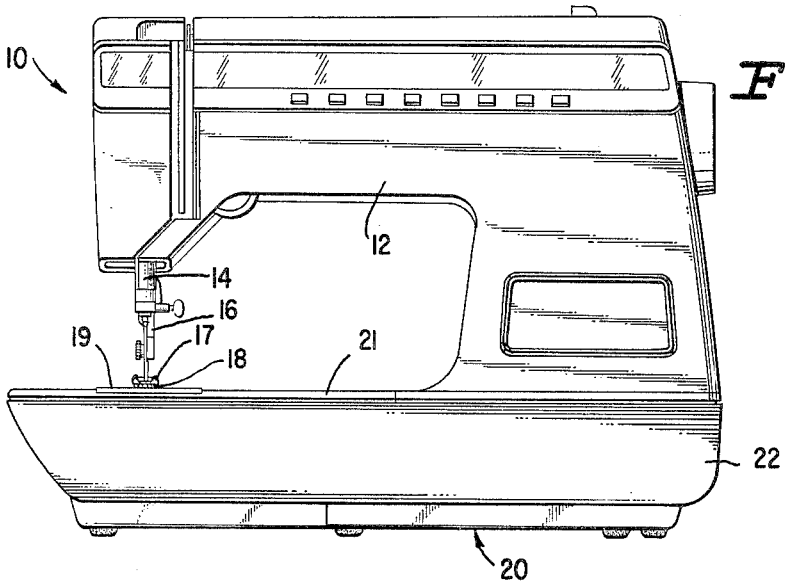
Fig. 1
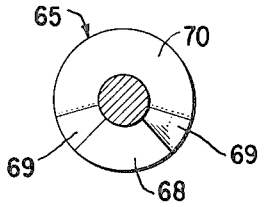
Fig. 5
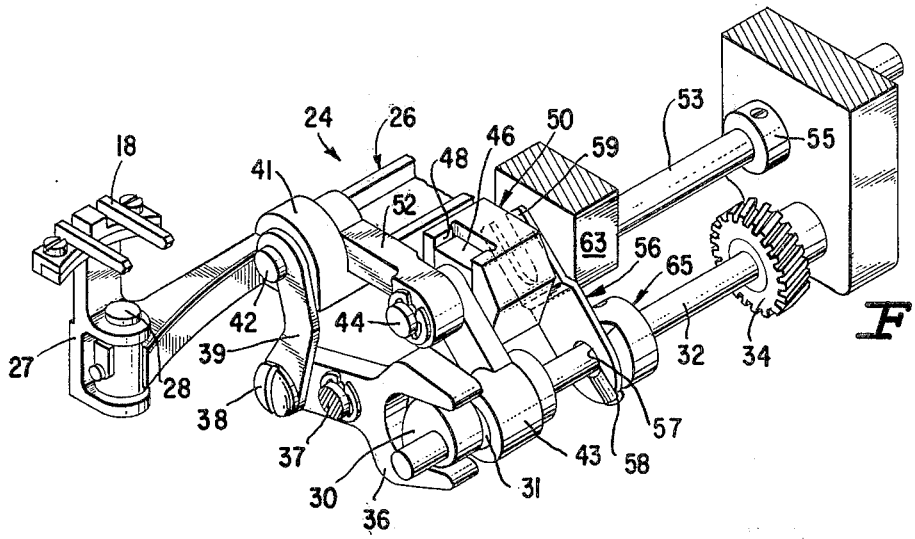
Fig. 2
Fig. 3
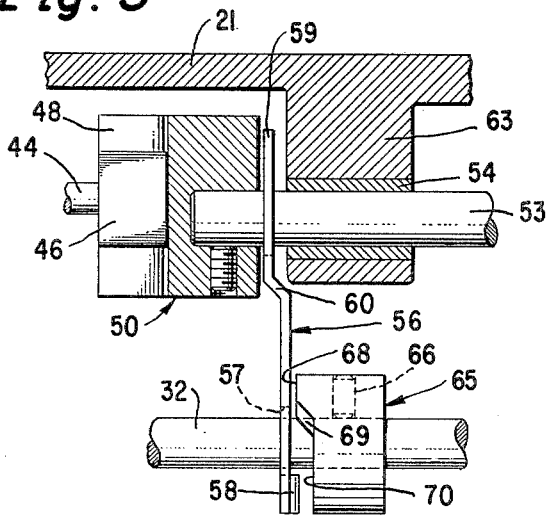
Fig. 4
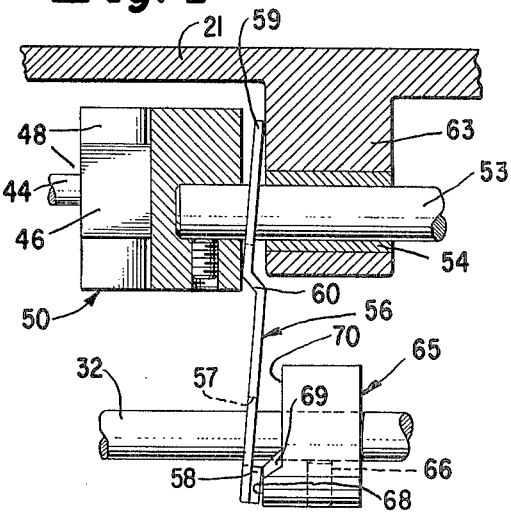

FEED REGULATOR CLAMPING DEVICE

BACKGROUND OF THE INVENTION

The invention is concerned with an improvement for a feed regulator for a sewing machine; more particularly, with a device to restrict the movement of a feed regulator while the transport of a work material is being effected.

In the prior art there are many examples of sewing machines having feed systems utilizing one or another form of feed regulator to permit adjustment of stitch length. In the bulk of these prior art feed systems it has been noted that an undue loading of the feed system, for example, by stitching on a heavy work material or by applying tension to the work material, can result in temporary or permanent repositioning of the feed regulator by the feedback of forces to the regulator through the feeding dogs.

In those machines where the position of the feed regulator is controlled by means of a manually variable cam and/or by a work patterning cam, the feed back of forces through the feeding dog can be controlled by means of a spring acting on the feed regulator in a fashion to press the cam followers against the cams. Thus the feedback forces are compensated for to the extent of the force exerted by the spring. Problems have been encountered in those sewing machines having provisions for quick reverse through a depressible control in that a spring force which may be appreciable must be overcome; and in those sewing machines having a work patterning cam in that a cam material is required which is sufficient to withstand the spring force.

What is required is a feed system which is not effected by feedback of forces through the feeding dog, without the necessity for spring bias forces, and the adverse results thereof, heretofore required.

SUMMARY OF THE INVENTION

The above requirement is satisfied in a feed system wherein the position of a feed regulator is clamped during that part of a feed system cycle when transport of a work material is being effected. The clamping action is achieved by vastly increasing the frictional resistance to rotation of the feed regulator during the feeding portion of the feed system cycle. A face cam, supported on a feed shaft also supporting a feed dog lift cam, is positioned adjacent a clamping plate also supported on the feed shaft in a fashion to have a portion thereof interposed between the feed regulator and a boss on the sewing machine frame. The clamping plate is fashioned with a lateral protuberance which will cooperate with a lateral rise on the face cam intermittently to cant the interposed portion of the clamping plate into intimate contact with the feed regulator and the boss on the sewing machine frame, thereby greatly to increase frictional resistance to rotation of the feed regulator. The position of the face cam on the feed shaft may be adjusted laterally for greater or lesser frictional resistance or may be rotated on the feed shaft to operate in synchronism with the feed dog lift cam just prior to contact of the feed dog with work material.

DESCRIPTION OF THE DRAWINGS

For a better understanding of the invention and the advantages thereof, reference may be had to the attached specification and accompanying drawings wherein:

FIG. 1 is an elevation of a sewing machine in which the invention may be incorporated;

FIG. 2 is a perspective view of the feeding system of the sewing machine shown in FIG. 1 with the invention incorporated therein;

FIG. 3 is an enlarged elevation of the invention, partially in section, shown in the inactive state;

FIG. 4 is a view similar to FIG. 3 but with the parts of the invention shown in the locked state; and, FIG. 5 is an axial elevation of the face cam showing the lands and transition zones thereof.

Referring to FIG. 1 there is shown a sewing machine 10 within which the invention finds utility. The sewing machine 10 includes an arm portion 12 within which is supported for endwise reciprocation a needle bar 14, which may also be adapted to undergo lateral oscillation under the influence of instrumentalities (not shown) elsewhere supported within the arm portion. Supported behind the needle bar 14 is a presser bar 16 terminating in a presser foot 17 adapted to press a work material against feed dog 18 when the feed dog is elevated above a throat plate 19. The arm portion 12 is supported by a bed portion 20 including a bed casting 21 and a bed cover 22. Throat plate 19 is supported on the bed portion 20.

Referring to FIG. 2 there is shown a feed system 24 supported within the bed cover 22 by the bed casting 21. The feeding system 24 includes a feed bar 26 having a support 27 connected by pin 28 at one end thereof for supporting the feed dog 18. The opposite end of the feed bar 26 (not shown) is pivoted for horizontal rotation about a vertically disposed pin itself pivoted on a horizontallly disposed pin for rotation in a vertical plane as is disclosed in the U.S. Pat. No. 3,527,183 issued Sept. 8, 1970, to the same assignee as the instant invention, which is hereby incorporated by reference and made a part of this application. Thus the feed bar 26 is able to accomodate and impart to the feed dog 18 horizontal feed advance and return motion as well as vertical motion to raise the feed dog to an active position and lower the feed dog to a feed return position, common to lower four motion feed systems. The feeding cycle is implemented by feed cams 30, 31 supported on a feed shaft 32, revolving in synchronism with the endwise reciprocation of needle bar 14 under the influence of helical gear 34 operatively connected to actuating means (not shown) of the sewing machine. The feed cam 30 is of a constant breadth variety and is spanned by a feed fork 36 pivoted on pin 37 supported by the bed casting 21. The opposite end of feed fork 36 has connected thereto by shouldered screw 38, a link 39 which extends to and is pivotably connected with lug 41 of the feed bar 26 by means of stud 42. Thus as the feed shaft 32 revolves, the feed cam 30 by means of the feed fork 36 and connecting link 39 raises and lowers the feed bar 26 and the feed dog 18 connected therewith to a feeding position or a return position. The feed cam 31 is encircled by a pitman 43 which extends to a pin 44 connected with slide block 46 slideably accomodated in slot 48 of feed regulator 50. The pin 44 connected to slide block 46 also supports one end of a connecting link 52 the other end of which also extends to the stud 42 carried by the lug 41 of feed bar 26. Thus, as is well known in the art, when the slot 48 of the feed regulator 50 is aligned with the motion of the pitman 43 imparted by the feed cam 31 no resulting horizontal motion of the feed bar 26 results. However, if the feed regulator 50 has its slot 48 inclined at an angle to the motion of the pitman 43 a portion of the motion imparted to the pitman by feed cam 31 is converted to horizontal motion and transferred to the feed bar 26 by the connecting link 52. An inclination of the slot 48 to one side of the motion of the pitman 43 will result in forward feed, while an inclination of the slot 48 to the other side of the motion undergone by pitman 43 will result in reverse feed. The feed regulator 50 is supported on a shaft 53, journaled in bushings 54 (see also FIGS. 3 & 4), whereby the inclination of the slot 48 may be selectively varied in order to vary the magnitude and direction of the feed. Suitable means such as collars 55, one of which is shown, are provided to remove end play from the shaft 53 for a purpose which will be explained below.

There is also shown in FIG. 2 a clamping plate 56 supported on feed shaft 32 by means of hole 57 in the clamping plate through which the feed shaft extends. The end of the clamping plate 56 opposite that in which the hole 57 is located is formed in a fork 59 straddling the feed regulator shaft 53 in between the feed regulator 50 and boss 63 of bed casting 21 closely adjacent the feed regulator. That portion of the clamping plate 56 in which the fork 59 is located is shifted over from the portion in which the hole 57 is located for a purpose which will be explained below. The clamping plate 56 is additionally formed with a protuberence 58 extending from the hole 57 to the end of the clamping plate. Supported on the feed shaft 32 immediately adjacent the clamping plate 56 is an end cam 65. The end cam 65 is adjustably connected to the feed shaft 32 by means of set screw 66. The end cam 65 has a rise portion 68 flanked by two transistion portions 69 leading to return portion 70 (see also FIG. 5).

In FIG. 3 is shown an enlarged elevation partially in section of the relationship between the feed regulator 50 the clamping plate 56 and the end cam 65 in the inactive state, that is, during the time when the feed dog 18 is not in contact with work material and the position of the feed regulator 50 may be changed at will. It is apparent that the position of the feed regulator shaft 53 may be changed at will with little or no frictional resistance. The rise portion 68 of the end cam 65 is out of engagement with the protuberance 58 on the clamping plate 56. Referring to FIG. 4 it may be observed that the end cam 65 has rotated to a position where the rise portion 68 of the end cam is in engagement with the protuberance 58 on the clamping plate 56, causing the clamping plate to pivot about the extremity of the fork 59 into engagement with the feed regulator 50, thereby creating a condition of high frictional resistance to further rotation of the feed regulator shaft 53. An inspection of FIG. 4 will indicate that the portion of the clamping plate 56 which impinges on the feed regulator 50 is offset from that portion of the clamping plate in which the protuberance 58 in the hole 57 encircling the feed shaft 32 are situated. The offset edge 60 which impinges on the feed regulator 50 insures a clamping of the feed regulator without any spurious rotation thereof due to impinging against an angular edge of the regulator (see FIG. 2). By removing end play in the feed regulator shaft 53 by suitable positioning of the collars 55, the load applied by the offset edge 60 of the clamping plate 56 will be fully effective without shifting of the feed regulator 50.

The circumferential position of rise portion 68 of the end cam 65 with respect to the feed cam 30 may be adjusted so that the clamping plate 56 engages with the feed regulator 50 coincident with or just prior to engagement of the feed dog 18 with a work material.

Thus there has been disclosed a device compatible with a sewing machine feed system which will permit feed adjustment to be made when the feed dogs are not in contact with a work material, but will drastically increase the frictional resistane to change of position of the feed regulator at a time when the feed dog is in contact with work material. The effect of the drag of heavy fabric on the feed dog 18 or of an operator pulling on the work material or of stitching over hurdles is minimized by the increased frictional resistence to rotation of the feed regulator 50 during that portion of the cycle when the feed dog 18 is in contact with a work material. The frictional resistence to change of position of the feed regulator may be varied by lateral shifting of the end cams 65 on the feed shaft 32. Thus to increase frictional resistence the end cam 65 may be shifted laterally on the feed shaft 32 to increase the pressure imparted to the clamping plate 56. The clamping plate 56 may be rigid, or, preferably, semi-rigid to accommodate slight axial misplacement of the end cam 65.

Having thus set forth the nature of this invention, what is claimed herein is:

1. In a sewing machine having stitch forming mechanism including a work feeding mechanism actuated cyclically in timed relation with said stitch forming mechanism, a stitch length regulator associated with said work feeding mechanism, and clamp means for said stitch length regulator effective for only a portion of each cycle of operation of said work feeding mechanism.

2. In a sewing machine having work feeding mechanism including a work feed dog, mechanism for alternately imparting active work feeding and idle return motion to said work feed dog, a regulator for varying the magnitude and direction of said work feeding motions, and feed regulator clamping means effective during each active work feeding motion of said work feed dog.

3. In a sewing machine having a frame including, arm and bed portions; a throat plate having slots therein supported on said bed portions; a work feeding mechanism comprising a work feed dog adapted to extend intermittently through said throat plate slots, means for intermittently elevating said feed dog to extend through said throat plate slots, means for imparting work feeding motion to said feed dog when extended through said throat plate slots, a regulator for varying the magnitude and direction of said work feeding motions, and a clamping means operating simultaneously with said means for intermittently elevating said feed dog to clamp said regulator when said feed dog is extended through said throat plate slots.

4. In a sewing machine as claimed in claim 3 wherein said means for intermittently elevating said feed dog to extend through said throat plate further includes a first rotating cam means for alternately elevating and lowering said feed dog through said throat plate slots; and wherein said clamping means further includes a clamping member. and a second rotating cam means operating in synchronism with said first rotating cam means for urging said clamping member into intimate contact with said regulator when said feed dog is extended through said throat plate slots.

* * * * *